US009095204B2

(12) United States Patent
Ou

(10) Patent No.: US 9,095,204 B2
(45) Date of Patent: Aug. 4, 2015

(54) LEISURE EQUIPMENT WITH A HANGING ASSEMBLY

(71) Applicant: Mei-Yueh Ou, New Taipei (TW)

(72) Inventor: Mei-Yueh Ou, New Taipei (TW)

(73) Assignee: Mei-Yueh Ou, New Taipei (TW)

( * ) Notice: Subject to any disclaimer, the term of this patent is extended or adjusted under 35 U.S.C. 154(b) by 0 days.

(21) Appl. No.: 13/925,861

(22) Filed: Jun. 25, 2013

(65) Prior Publication Data

US 2014/0000026 A1 Jan. 2, 2014

(30) Foreign Application Priority Data

Jun. 28, 2012 (TW) ..... 101123130 A

(51) Int. Cl.

| | |
|---|---|
| ***A45F 3/22*** | (2006.01) |
| ***A45F 3/26*** | (2006.01) |
| ***A47C 17/84*** | (2006.01) |
| *A63G 9/00* | (2006.01) |
| *A45F 3/24* | (2006.01) |

(52) U.S. Cl.

CPC ... *A45F 3/22* (2013.01); *A45F 3/26* (2013.01); *A47C 17/84* (2013.01); *A45F 3/24* (2013.01); *A63G 9/00* (2013.01)

(58) Field of Classification Search

CPC ..... A45F 3/24; A45F 3/26; A45F 3/22; A47C 17/84; A47C 3/0255; A63G 9/00

USPC ..... 5/81.1 R, 85.1, 87, 83.1

See application file for complete search history.

(56) References Cited

U.S. PATENT DOCUMENTS

| | | | | |
|---|---|---|---|---|
| 4,002,368 | A * | 1/1977 | Ortize | 297/273 |
| 4,101,165 | A * | 7/1978 | Hammer | 297/273 |
| D336,378 | S * | 6/1993 | Kittridge | D6/344 |
| D348,161 | S * | 6/1994 | Craig, III | D6/500 |
| 5,511,256 | A * | 4/1996 | Capaldi | 5/83.1 |
| 5,809,591 | A * | 9/1998 | Capaldi et al. | 5/83.1 |
| 6,174,010 | B1 * | 1/2001 | Fanger et al. | 294/81.4 |
| 8,397,320 | B2 * | 3/2013 | Capaldi | 5/85.1 |
| 2003/0084508 | A1 * | 5/2003 | Faucher et al. | 5/81.1 R |
| 2012/0198612 | A1 * | 8/2012 | Tindall | 5/83.1 |
| 2014/0000025 | A1 * | 1/2014 | Hushek | 5/86.1 |

* cited by examiner

*Primary Examiner* — Peter M Cuomo
*Assistant Examiner* — Britanny Wilson

(57) ABSTRACT

An approach is provided a leisure equipment with a hanging assembly that comprises a processing module and a hanging module. The processing module comprises a slide rail and a slider. The slider is moved along the slide rail, connects to the hanging module to drive the hanging module moving, swing or swaying along the slide rail, and is able to self rotation. The leisure equipment is able to be used adaptively indoor or outdoor to comfort peoples' mind and body, and feel the natural rhyme simultaneously. For handicapped people which it provides assistants of exercise or movement of a specific portion of body which is useful to loosen up muscles and release the mind.

18 Claims, 12 Drawing Sheets

LEISURE EQUIPMENT WITH A HANGING ASSEMBLY

FIELD OF THE INVENTION

Embodiments of the present invention relate to leisure equipments, especially toward a leisure equipment with a hanging assembly that is able to comfort a person's mind and body.

BACKGROUND

More and more people face huge pressure due to a change of life style or a competition of career environment. The pressure not only reflects in the mental perception (such as anxiety), but also influents the health. The most common symptoms include fatigues of neck and/or shoulder and back pain.

There are many leisure equipments existed in the market that try to relief the symptoms causes by pressures, such as massage chairs or vibration equipments. However, abovementioned equipments are only able to comfort body but are not able to eliminate the stress and uncomfortableness in a limited indoor environment. Accordingly, it would be better if some outdoor leisure equipments can be used as household equipments, which makes a person does not need to go outside and still feel outdoor comfort. It helps people to relieve their mental when their body is relaxed.

For example, a hammock is commonly connected between two trees in a forest recreational area. A person is able to lie in the hammock and breathe the phytoncide to feel the peace and enjoy the movement of the hammock which release the person from the panics and rush in his/her daily busy life. Therefore, if such hammock can be adaptively used as the household leisure equipments, it truly helps us to release the pressures and tensions, and balances our physical body, and spiritual mind.

SOME EXEMPLARY EMBODIMENTS

These and other needs are addressed by the present invention, wherein an approach is to provide a leisure equipment with a hanging assembly, which is able to be used adaptively indoor or outdoor to comfort peoples' mind and body, and feel the natural rhyme simultaneously.

Another approach of the present invention is to provide a leisure equipment with a hanging assembly, which is able to achieve a purpose of learning certain sports' movements or activities.

Other approach of the present invention is to provide a leisure equipment with a hanging assembly, which is adaptively for a handicapped person assisting exercise or movement of a specific portion of body.

In one embodiment, the leisure equipment with a hanging assembly comprises a processing module and a hanging module. The processing module is mounted on a high elevated location, and comprising a sliding rail, a slider is disposed on the sliding rail and moves along the sliding rail or self-rotates in a specific point of the sliding rail, and at least one processing motor drives the slider moving on the sliding rail based on a predetermined regulation.

The hanging module is driven by the process motor to form a moving tracking and comprising net body is weaved by multiple ropes. The net body comprises an upper end, a lower end, a left end, and a right end. The rope of the upper end are passes through holes of a collector and are collected to form a hanged end that is mounted to the slider of the processing module. The lower end is formed by twisting ropes, and has two ends for two fixed ropes disposed on. The left end and the right end respectively comprises multiple auxiliary units, each auxiliary unit is formed by twisting multiple ropes. The auxiliary unit is hold or grasped by the user to maintain the stability while the processing module is operating.

BRIEF DESCRIPTION OF THE DRAWINGS

The invention is illustrated by way of example, and not by way of limitation, in the figures of the accompanying drawings in which like reference numerals refer to similar elements and in which.

DESCRIPTION OF THE PREFERRED EMBODIMENT

A leisure equipment with a hanging assembly is disclosed. In the following description, for the purposes of explanation, numerous specific details are set forth in order to provide a thorough understanding of the present invention. It is apparent, however, to one skilled in the art that the invention may be practiced without specific details or with an equivalent arrangement.

Figure 1:
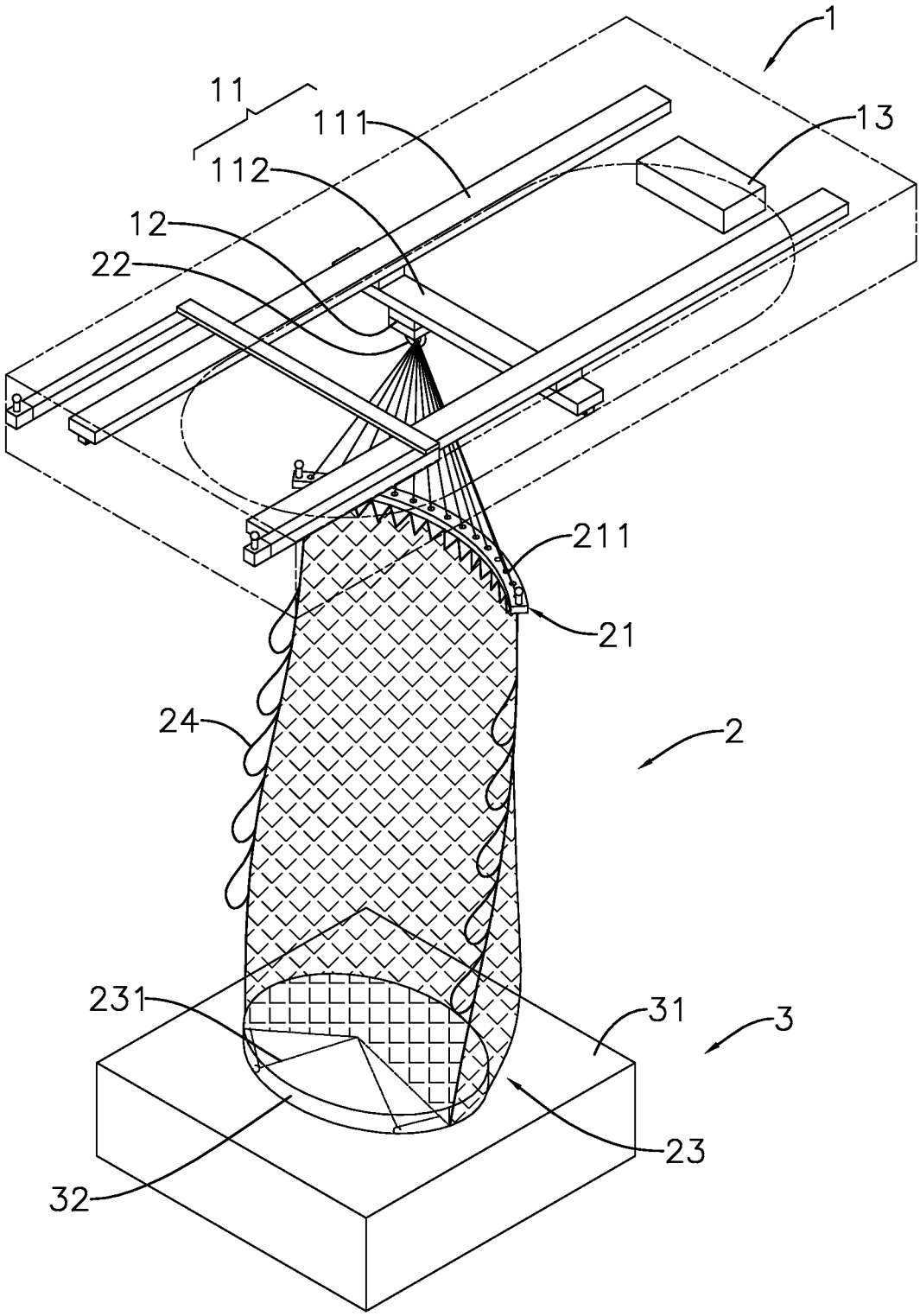
FIG. 1 is a perspective diagram of illustrating a leisure equipment with a hanging assembly in accordance with an embodiment of the present invention.
Figure 2:
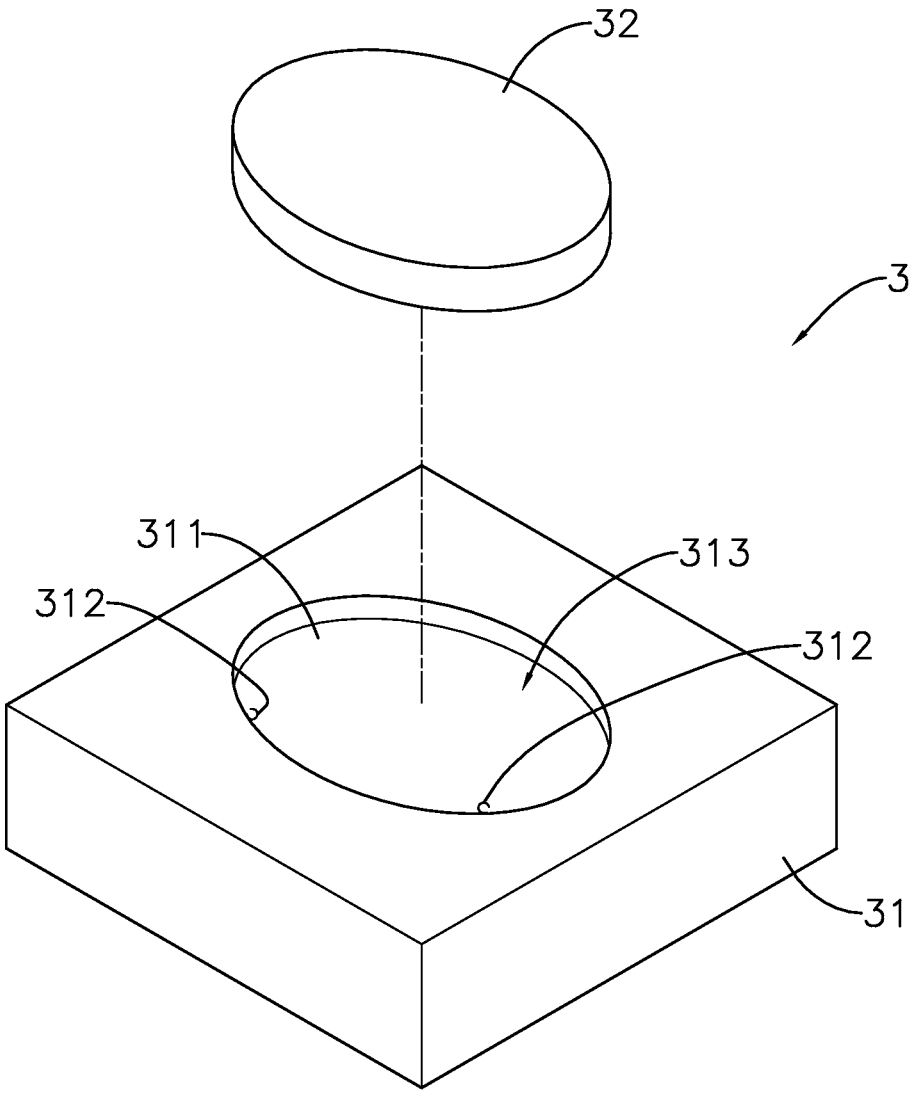
FIG. 2 is an exploded view of a sitting module in FIG. 1.

With reference to FIGS. 1 and 2, the leisure equipment with a hanging assembly comprises a processing module 1, a hanging module 2 and a sitting module 3.

The processing module 1 is mounted on a high elevated location (i.e. ceiling), and comprises a sliding rail 11, a slider 12 and a processing motor 13. In this embodiment, the sliding rail 11 further comprises two first tracks 111 that are paralleled to each other, and a second track 112 that is vertically arranged between two paralleled first tracks 111. The slider 12 is disposed on the second track 112 that is able to slide along the second track 112 or self-rotating at a fixed location of the second track 112. The processing motor 13 either drives the slider 12 moving along the second track 112 or drives the second track 112 moving along the first tracks 111.

The hanging module 2 is driven by the processing motor 13 to form a moving tracking, and comprises a net body with a collector 21 and a hanged end 22. The net body is weaved by multiple ropes and comprises an upper end, a lower end, a left end and a right end. Each rope of upper end of the net body is passed through a corresponding hole 211 disposed on the rectangled collector 21 and multiple ropes of the net body are collected to form the hanged end 22. The hanged end 22 is mounted with the slider 12 of processing module 1, thus the hanging module 2 is driven to shack, swing, or sway while the slider 12 moving along the sliding rail 11.

Ropes elongated to the lower end of the net body are twisted to form a lower edge 23 with multiple nodes. The lower edge 23 has two ends that are respectively connected to a fixed rope 231.

The net body further comprises two rows of auxiliary unit 24 respectively disposed on left end and the right end of the body. Each auxiliary unit 24 is twisted by multiple ropes and is able to be held, grabbed or worn by the hand. Accordingly, a person is able to feel comfortable while the hanging module 2 is shaking or moving. The net body allows the person against it in a stable position inside the net body and holding the auxiliary unit 24.)

Further, in the actual practicing of the present invention, the slider 12 is not only limited to move along the sliding rail 11 of the processing module 1. The slider 12 may further rotate at a specific point which achieves at least two movement fashions of self-rotating and moving.

With reference to FIG. 2, the sitting module 3 is placed under the hanging module 2 and comprises a lower pad 31 and an upper pad 32. The upper pad 32 is disposed inside a concave 311 mounted on an upper surface of the lower pad 31. The concave 311 has an inner edge for mounting multiple hooks 312.

The upper pad 32, in an embodiment, is configured for multiple usages. For example, the upper pad 32 may be used as a cap that fastens the lower end of the net body between the upper pad 32 and the lower pad 31 when a person is using the hanged leisure equipment. Alternatively, the upper pad 32 can be applied as a pillow.

Figure 3:
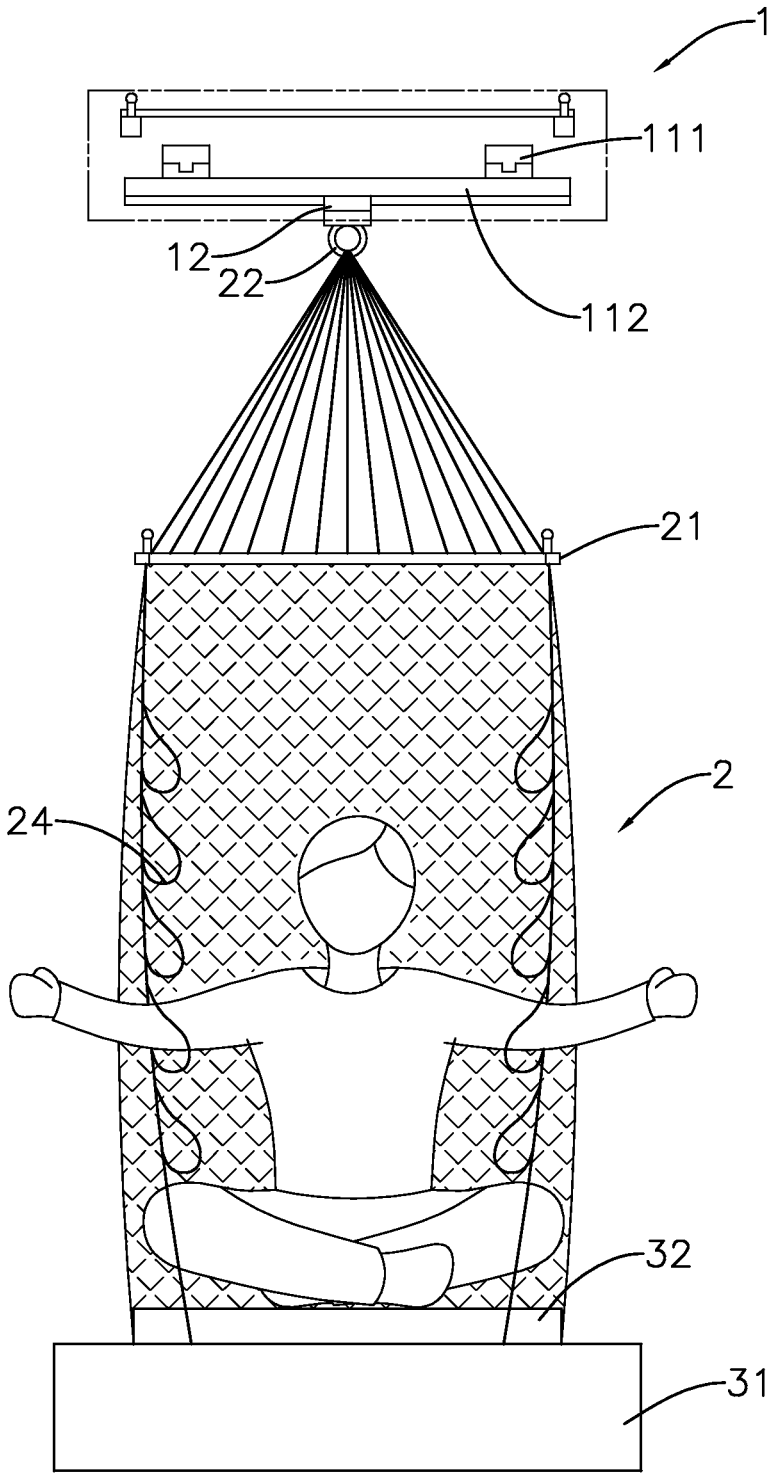
FIG. 3 is a diagram of illustrating a use of the hanged leisure equipment of FIG. 1 in accordance with an embodiment the present invention.

FIGS. 1 to 3 disclose an embodiment for using the hanged leisure equipment of the present invention. In this embodiment, the person may sit on the hanged leisure equipment as the upper pad 32 being removed out for fastening the lower end of the net body in the concave 311 of the lower pad 31. The fixed rope 231 of the hanging module 2 is firstly configured for coupling to the hooks 312, and then allows the upper pad 32 placed on the concave 311 to fix the lower end of the net body. Therefore, the hanging module 2 is perpendicular to the sitting module 3 and the person's weight will be loaded on the sitting module 3 to strength of the fixed rope 231 while the person is in a sitting pose. In the other words, the lower end of the net body of the hanging module 2 will not slide out from the upper pad 32 and the lower pad 31 while the net body is swing, rotating or moving. Also, the hanging module 2 provides support from the back, so that the person will feel free to lean against to the hanging module 2. The hanging module 2 is configured for swing, rotating or moving whereby the slider 12 moving along the second track 112 or the second track 112 is moving along the first tracks 111 by the motor 13.

Further, the hand(s) or the arm(s) is able to grab or pass through the auxiliary unit 24 to prevent the person from losing stability or falling down from the hanged leisure equipment due to the moving or swing of the hanging module 2, so that the person not only feels comfort of the body, but also feels the relief of the mind due to entirely leaning pose on the hanged leisure equipment with the movement of swing, swaying and shaking of the hanged leisure equipment.

In additional, the sitting module 3 of this embodiment uses the hooks 312 to fasten the fixed rope 231 of the hanging module 2, which avoids the hanging module 2 sliding out from the upper pad 32 and the lower pad 31 of the sitting module 3 that causes harms/dangers to the person. However, it is not limited to use the hook 312, any person has ordinary skill in the art is easily understood that a bolt, a button, or a fastener (not shown) can be achieve same benefits of fixing the lower end of the hanging module 2 to the lower pad 31 of the sitting module 3.

Further, due to a limited living space, the lower pad 31 of the sitting module 3 may further have a container to increase usability of the lower pad 31. In our normal daily life, the hanging module 2 can be collected from the processing module 1 and placed in the container of the sitting module 3. In this manner, the person does not need to prepare a specific container or space to hold the hanging module 2. Also, it lowers the risk of losing the hanging module 2 when the hanged leisure equipment has not been used for period of time. In this embodiment, the concave 311 of the lower pad 31 is the container to hold the hanging module 2.

Figure 4:
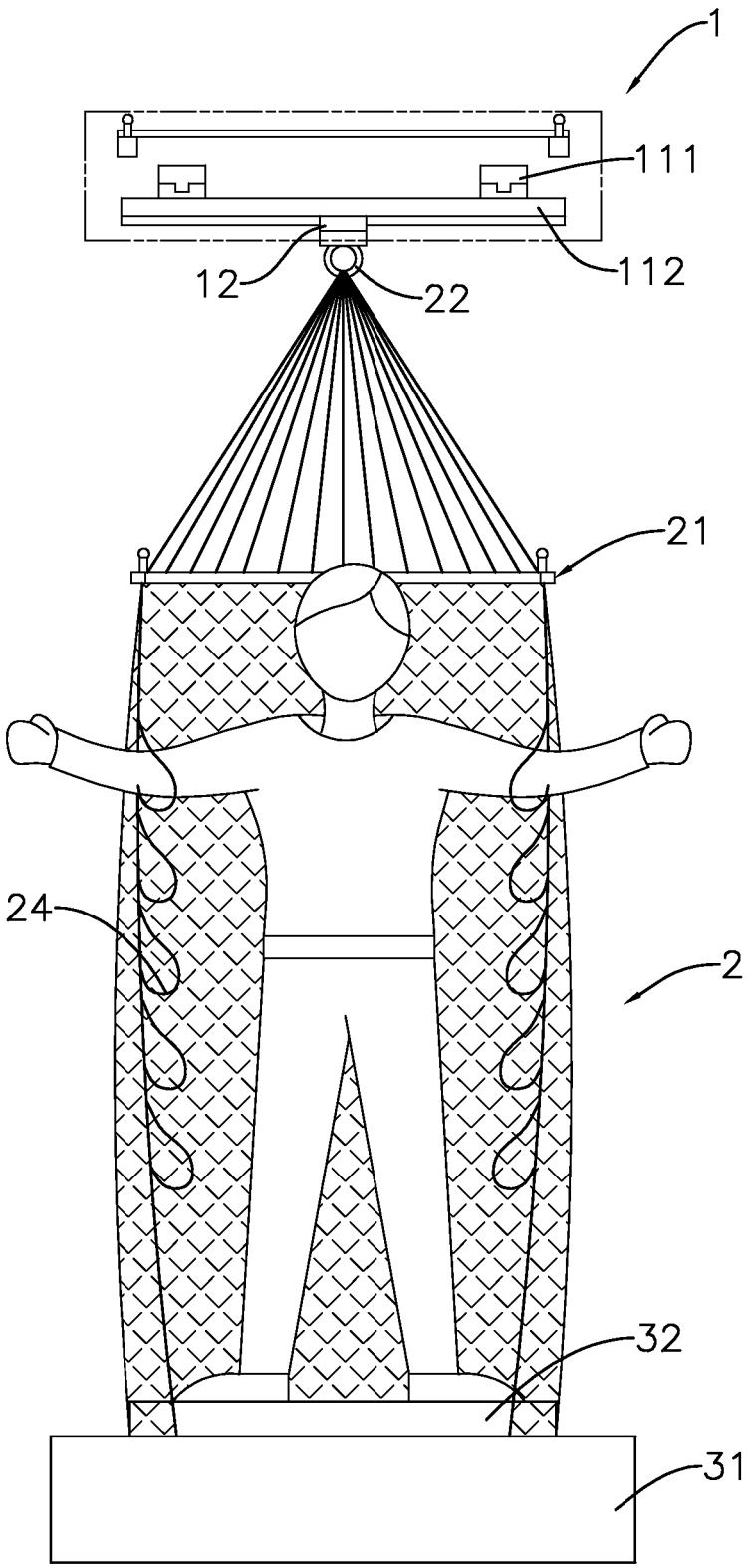
FIG. 4 is a diagram of illustrating another use of the hanged leisure equipment of FIG. 1 in accordance with an embodiment the present invention.

With reference to FIG. 4, FIG. 4 shows another way of using the hanged leisure equipment which is similar to the FIG. 3. In this embodiment, the person is in a standing pose, so that the whole body can be comforted instead of the top upper body shown in FIG. 3.

However, no matter the person using the hanged leisure equipment of the present invention is in a sitting pose or standing pose. The hanged leisure equipment of the present invention may further optionally put in a water area such as a swimming pool, a SPA pool or a bathroom, which enhances the strength of the water buoyancy that achieves deeper relaxation for the person using the hanged leisure equipment in accordance of the present invention.

Figure 5:
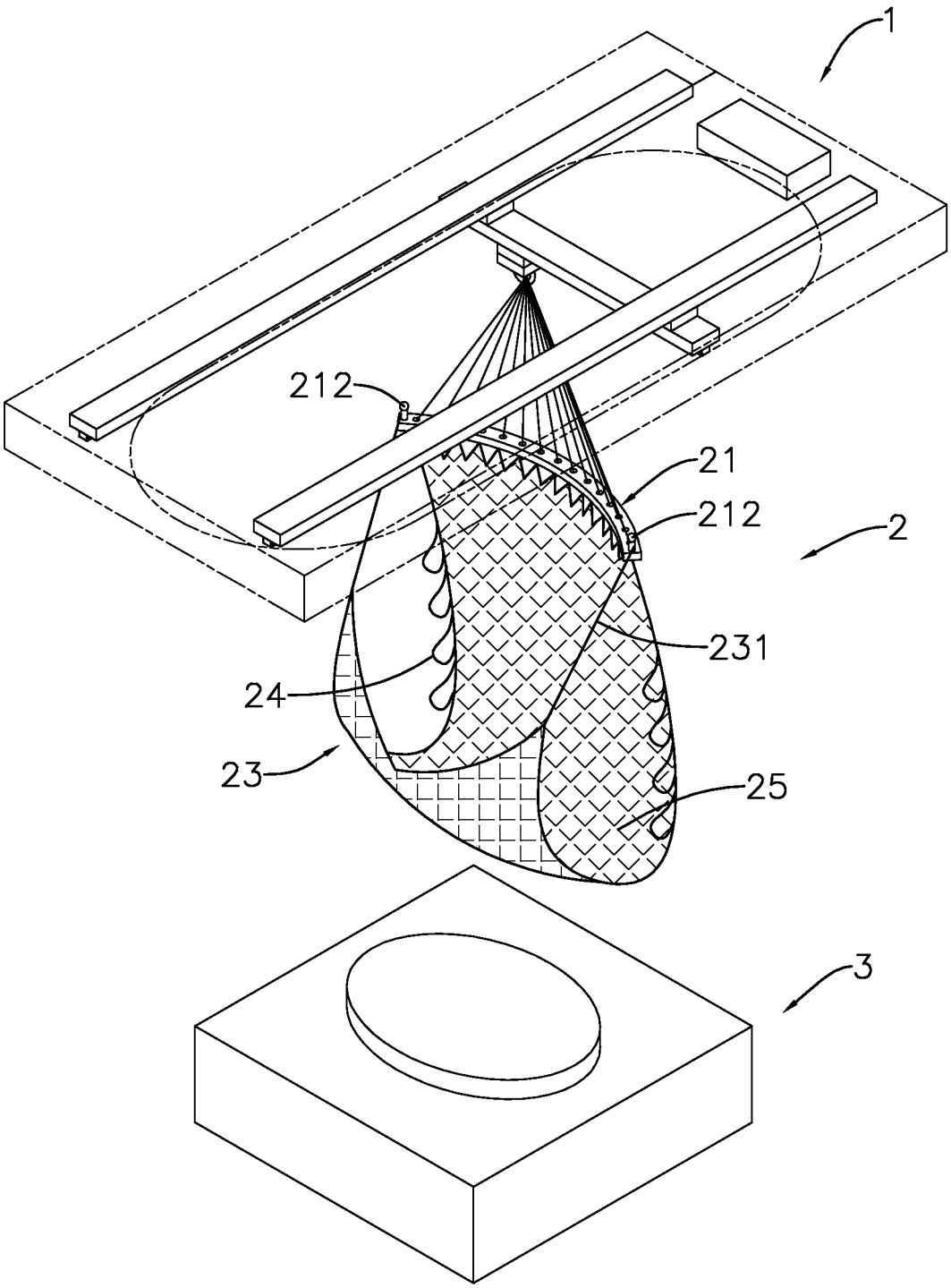
FIG. 5 is a perspective diagram of a assembly illustration for the hanged leisure equipment in accordance with an embodiment the present invention.

With reference to FIG. 5, FIG. 5 shows another way to use the hanged leisure equipment of the present invention. In this embodiment, the sitting module 3 is removed, and the collector 21 of the hanging module 2 has two first hooks 212 that are respectively connected to the two ends of the collector 21. The lower edge 23 of the net body is turned upwardly so that two fixed rope 231 are respectively coupled to the corresponding first hook 212 and the hanging module 2 forms a sitting groove 25 looked like a hanged chair. The person may able to sit in the sitting groove 25 with cross-legged or falling-legged position and further grab the auxiliary unit 24 to obtain the balance and stability while the hanged leisure equipment is swing, rotating or moving.

Figure 6:
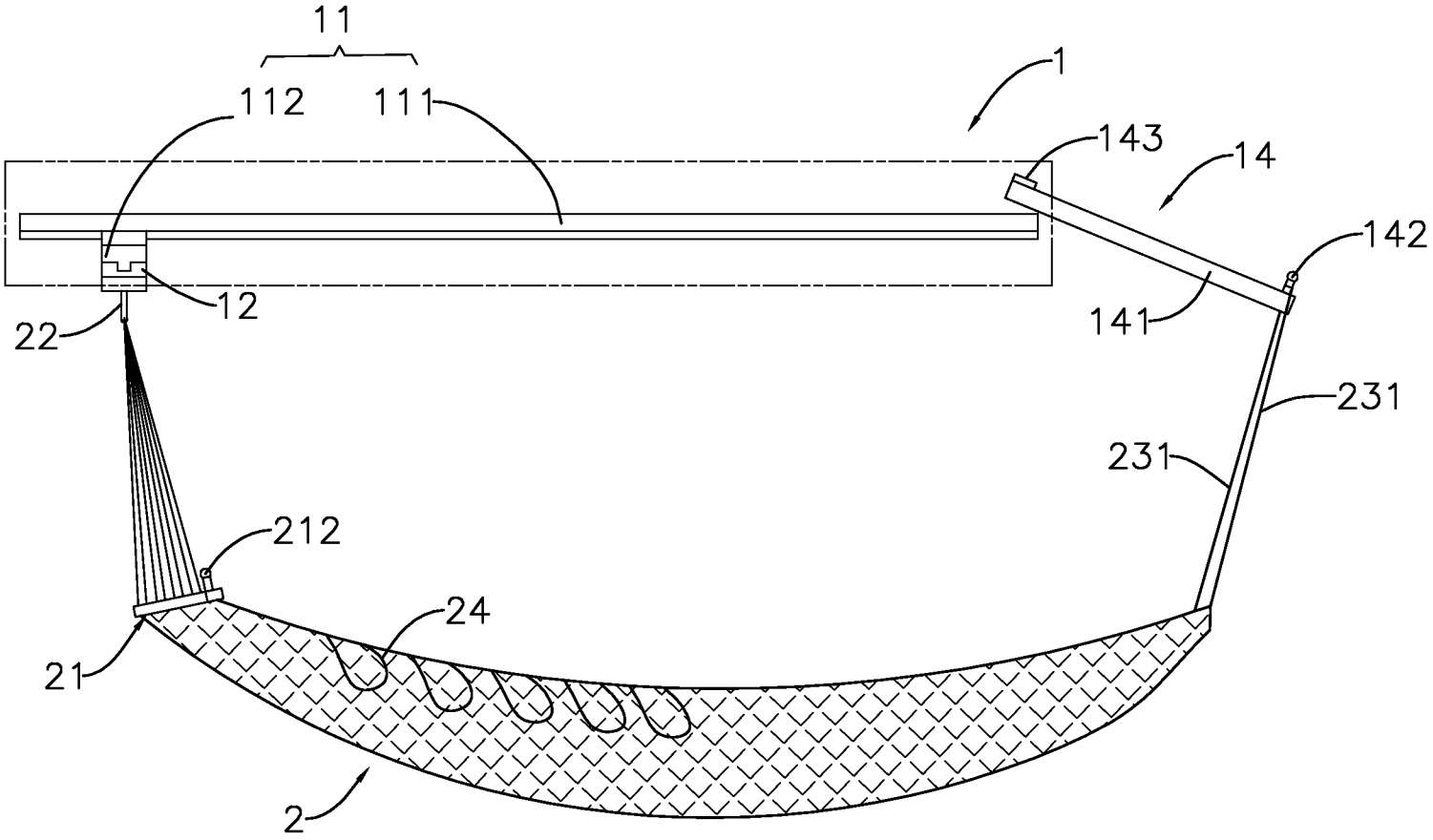
FIG. 6 is a diagram of a side view illustrating the hanged leisure equipment in accordance with another embodiment the present invention.

With reference to FIG. 6, illustrating a diagram of a side view of a leisure equipment in accordance with an embodiment the present invention. In this embodiment, the sliding rail 11 further comprises an elongation unit 14. The elongation unit 14 is inserted from a side end of the sliding rail 11, and comprises a pair of elongation rod 141, a connecting rod 143 and at least two second hooks 142. The elongation rods 141 are paralleled to the first track 111. The connecting rod 143 is orthogonally arranged to the elongation rods 141, and is connected to an inner side of the elongation rods 141. The two second hooks 142 are mounted respectively on an outer side of the corresponding elongation rod 141.

The elongation unit 14 is normally located inside the processing module 1. When using the elongation unit 14, in this embodiment, the elongation unit 14 is pulled out from the side end of the processing module 1, and the second track 112 is apart from the elongation unit 14. The fixed rope 231 of the hanging module 2 is couple with the second hook 142 on the elongation rod 141 of the elongation unit 14. Accordingly, an end of the elongation rod 141 with the exposed second hook 142 and the other end of the elongation rod 141 with the connecting rod 143, which acting as a lever and the end of the elongation rod 141 can be a fulcrum of the lever. The hanging module 2 is latitudinal extended that makes the hanged leisure equipment forming a hammock.

The motor 13 of the processing module 1 is able to move the second track 112 to a certain point on the first track 111 based on the person's height, and controls the slider 12 to moving back and forth on the second track 112 which generates a swing motion for the person on the hammock.

Figure 7:
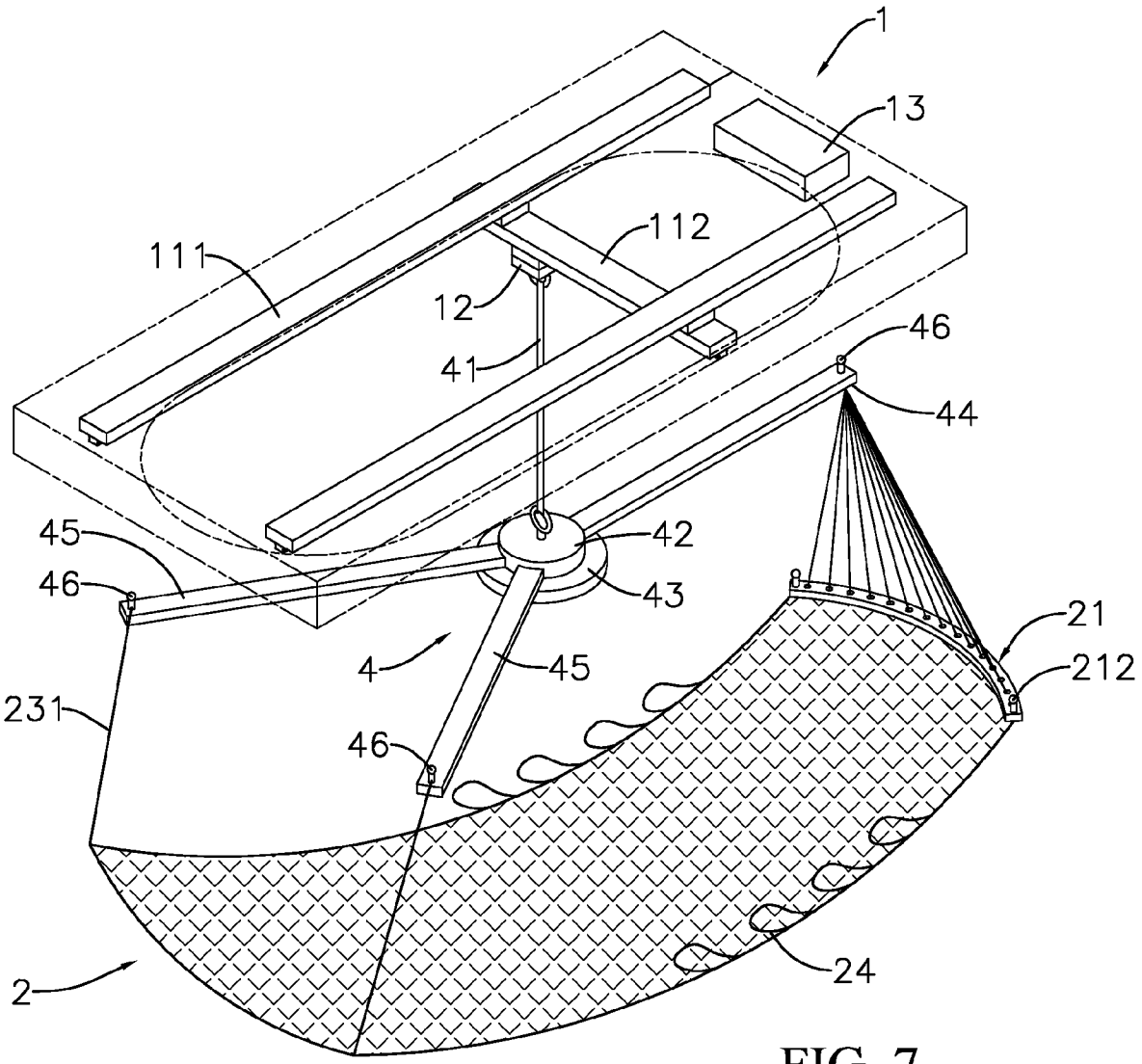
FIG. 7 is a perspective diagram for illustrating the hanged leisure equipment in accordance with yet another embodiment the present invention.

With reference to FIG. 7, illustrating a perspective diagram of the hanged leisure equipment in accordance with an embodiment the present invention. In this embodiment shown in FIG. 7 is different to the FIG. 6 which comprises an auxiliary hanging module 4 mounted between the processing module 1 and the hanging module 2.

The auxiliary hanging module 4 comprises a hanged rod 41 that has one end connected to the slider 12, an upper coupled unit 42 connected to the other end of the hanged rod 41, a lower coupled unit 43 connected to the upper coupled unit 42, a first hanged rod 44 extended from the upper coupled unit 42 and the lower coupled unit 43, and a pair of second hanged rod 45 extended from the upper coupled unit 42 and the lower coupled unit 43. The first hanged rod 44 and the second hanged rods 45 form a Y type and respectively has a third hook 46 on a far end of the first hanged rod 44 and the second hanged rods 45.

In this embodiment, the hanged end of the net body is coupled with the third hook 46 of the first hanged rod 44 and each fixed rope 231 is coupled with the third hook 46 of the corresponding second hanged rod 45 to spread out the net body of the hanging module 2. The auxiliary hanging module 4 is rotated by the motor 13 driving the hanged rod 41 self-rotating, and is swayed by the slider 12 driving the auxiliary hanging module 4 moving along the sliding rail 11. Accordingly, the moving, swing or rotating of the auxiliary hanging module 4 is helpful to release the mental stress, to relax the physiological pressure and to feel comfortable and peace.

Figure 8:
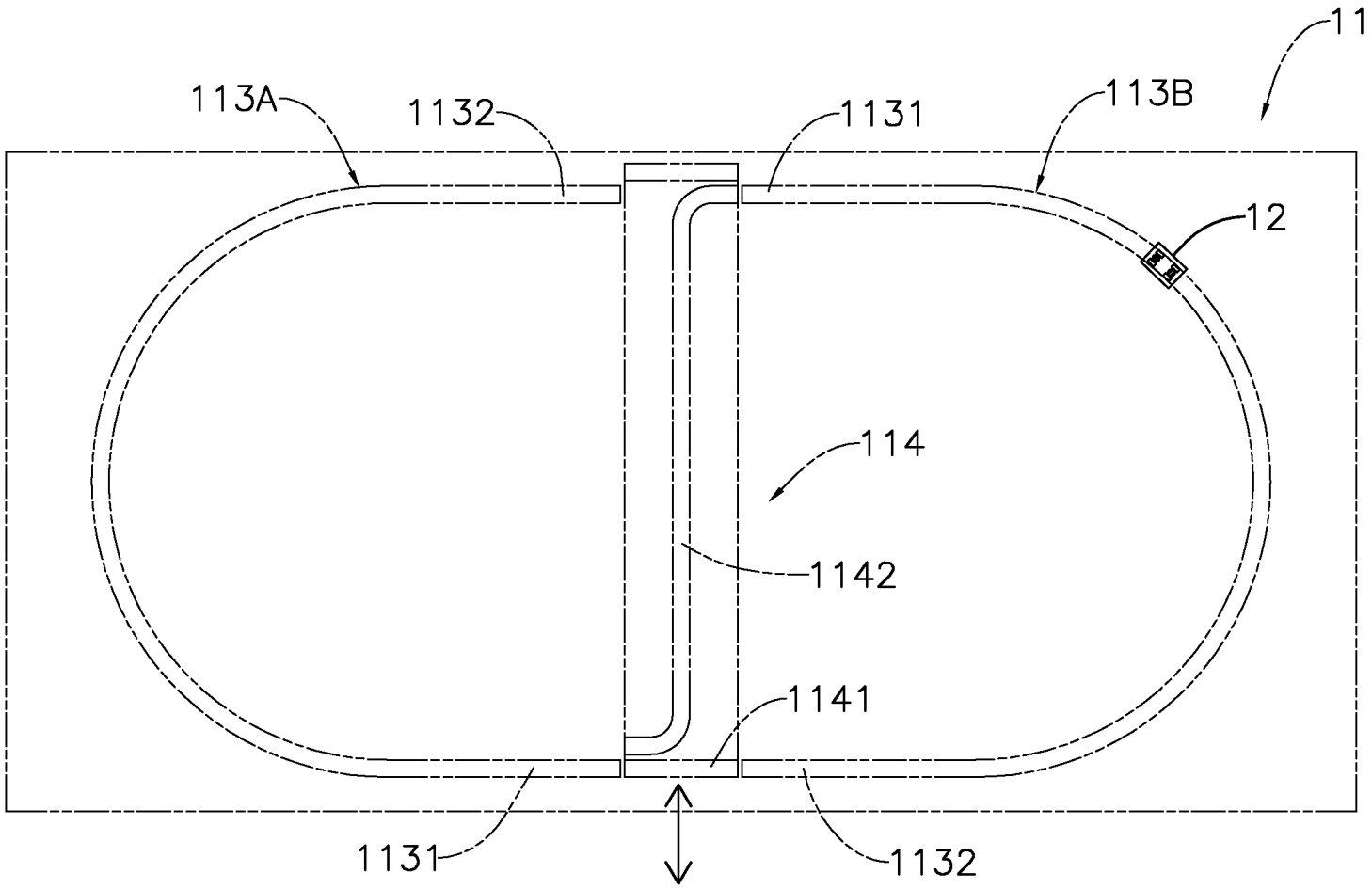
FIG. 8 is a diagram of illustrating a sliding rail of the hanged leisure equipment in accordance with other embodiment the present invention.

With reference to FIG. 8, FIG. 8 discloses another embodiment of the sliding rail of the hanged leisure equipment in accordance with the present invention. In this embodiment, the sliding rail 11 comprises a pair of U-track 113A, 113B and a movable track 114. The U-track 113A has an opening oppositely corresponds to an opening of the U-track 113B. Each U-track 113A, 113B has a first terminal 1131 and a second terminal 1132. The movable track 114 comprises a pair of sub-track 1141 and an S-track 1142. The pair of sub-track 1141 is paralleled to each other and is configured for connecting to the corresponding U-tracks 113A, 113B. One sub-track 1141 is connected between the first terminal 1131 of the U-track 113A and the second terminal 1132 of the U-track 113B and the other sub-track 1141 is connected between the second terminal 1132 of the U-track 113A and the first terminal 1131 of the U-track 113B. The S-track 1142 is mounted between the sub-tracks 1141 and connects the first terminal 1131 of the U-track 113A to the first terminal 1131 of the U-track 113B.

In this manner, the motor 13 controls the engagements among the U-tracks 113A, 113B and the movable track 114 to form different types of track for the slider 12. When the U-tracks 113A, 113B are connected to the sub-track 1141, the slider 12 moves in an oval-shaped. When the U-tracks 113A, 113B are connected to the S-track 1142, the slider 12 moves in an S-shaped.

Figure 9:
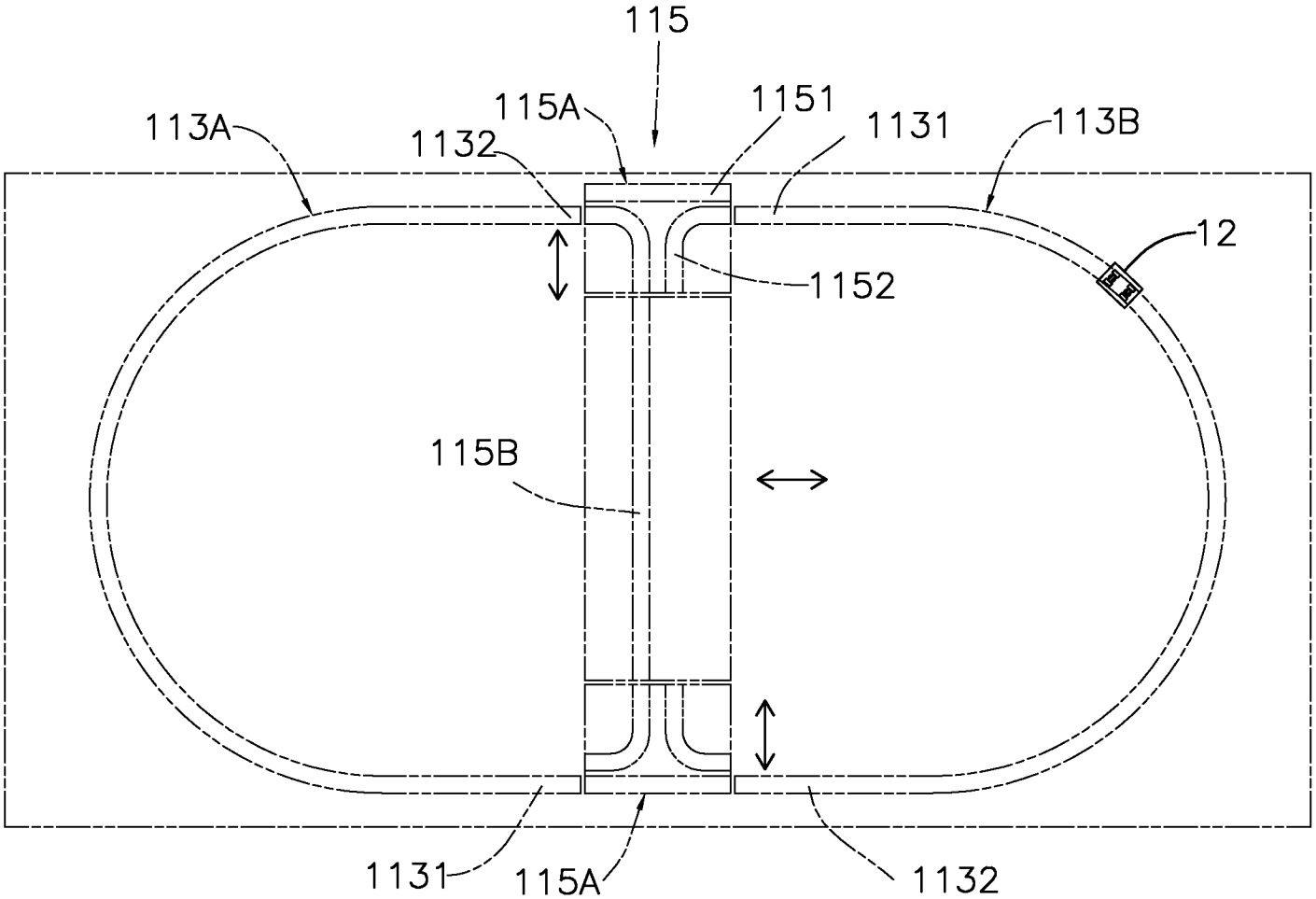
FIG. 9 is a diagram of illustrating another sliding rail of the hanged leisure equipment in accordance with an embodiment the present invention.

With reference to FIG. 9, FIG. 9 discloses another embodiment of the sliding rail of the hanged leisure equipment in accordance with the present invention. This embodiment is different from above-mentioned embodiment in FIG. 8 which comprises a movable track 115 that is formed between the U-tracks 113A and the U-tracks 113B. The movable track 115 is configured for moving upward or downward and comprises a pair of first movable track 115A and a second movable track 115B. The second movable track 115B is vertically located between the two first movable tracks 115A and is configured for moving leftward and rightward. Each first movable track 115A comprises a straight track 1151 and two opposite L-tracks 1152. The straight track 1151 is horizontally disposed between the U-tracks 113A, 113B and is configured to connect the first terminal 1131 of the U-track 113A (113B) with the second terminal 1132 of the U-track 113B (113A). The L-track 1152 has two ends, one end is connected to the first terminal 1131 or the second terminal 1132 of the U-track 113A (113B), another end is connected to the second movable track 115B.

When both straight tracks 1151 of two first movable tracks 115A are connected to the U-tracks 113A and the U-track 113B, it forms an oval-shaped sliding rail 11, which allows the hanging module 2 driven by the slider 12 to move along the oval-shaped sliding rail 11.

However, through the movement (i.e. leftward or rightward) of second movable track 115B, and adaptively connects the one corresponding L-track 1152 of the first movable track 115A to the second movable track 115B. It can form various types of movements including S-shaped, U-shaped and semi-oval shaped.

Figure 10A:
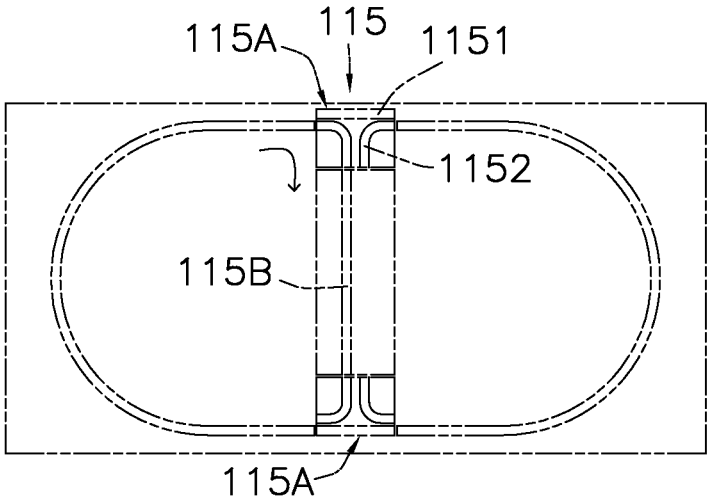
FIGS. 10A to 10C are diagrams of illustrating the sliding rail of FIG. 9 showing the S-shaped movement of the hanged leisure equipment in accordance with another embodiment the present invention.
Figure 10B:
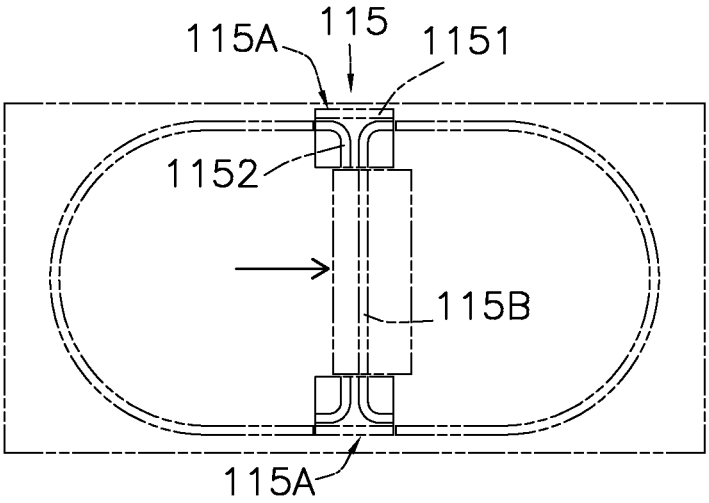
Figure 10C:
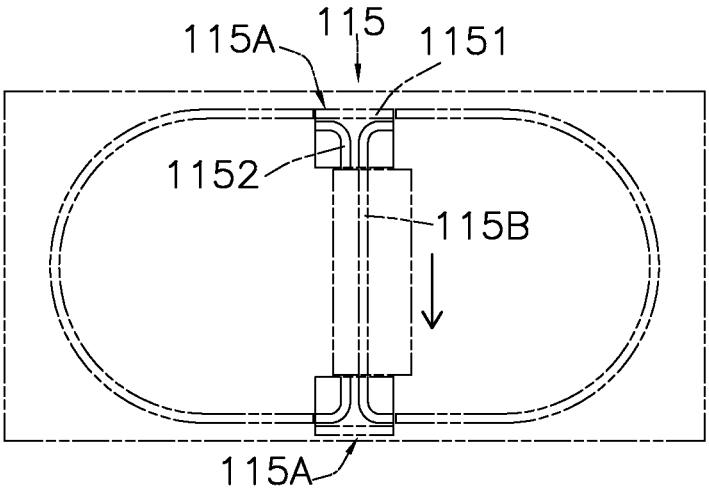

FIGS. 10A to 10C disclose the slider moving along an S-shaped sliding rail 11 respectively. In an embodiment, the slider (not shown) firstly moving from the left hand side of the L-track 1152 of the top first movable track 115A into the region of the second movable track 115B. The second movable track 115B is then move rightward which allows the slider continue moving downwardly to the right hand side of the L-track 1152 of the bottom first movable track 115A. Finally, the slider is moving into the U-track and completes the S-shaped movement.

Further, either the movable track 115 (in FIGS. 10A to 10C) or the movable track 114 (in FIGS. 8 and 9) is used, the slider 12 is able to implement straight movement (i.e. I-shaped movement) as long as it in a line track.

Figure 11A:
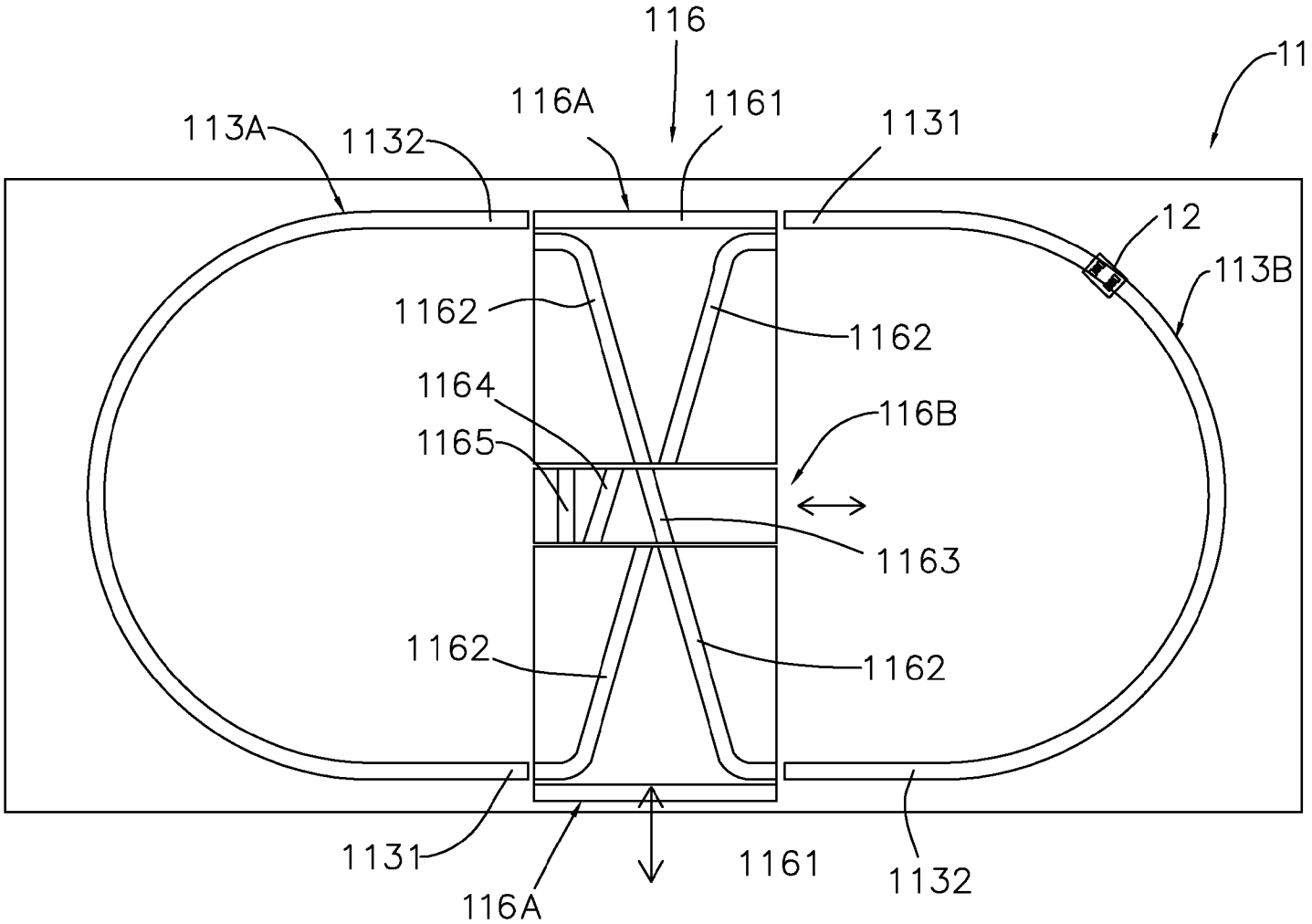
FIG. 11A is a diagram of illustrating another sliding rail of the hanged leisure equipment in accordance with another embodiment the present invention.

With reference to FIG. 11A, FIG. 11A discloses another embodiment of the sliding rail of the hanged leisure equipment in accordance with the present invention. This embodiment is different from previously mentioned embodiments. The hanged leisure equipment comprises a multi-movable track 116 that is disposed between the U-track 113A and 113B. The multi-movable track 116 is configured for moving upward or downward and comprises a pair of third movable track 116A and a fourth movable track 116B. The fourth movable track 116B is mounted between the pair of third movable track 116A and is configured for moving rightward and leftward.

Each third movable track 116A comprises a straight sub-track 1161 and a pair of inclined L-sub-track 1162 that are symmetrical to each other. The straight sub-track 1161 connects the first terminal 1131 of the U-track 113A and the second terminal 1132 of the U-track 113B or the first terminal 1131 of the U-track 113B and the second terminal 1132 of the U-track 113A. Each inclined L-sub-track 1162 connects the first terminal 1131 or the second terminal 1132 of the U-track 113A or 113B and the fourth movable track 116B. The fourth movable track 116B comprises a left-inclined sub-track 1163, a right-inclined sub-track 1164 and a straight sub-track 1165.

When the straight sub-track 1161 of the third movable tracks 116A is used to connect the U-track 113A and 113B, the sliding rail 11 is oval-shaped that is adaptively for the slider 12 to move in an oval-shaped movement.

However, when the inclined L-sub-track 1162 is used to connect the U-track 113A and 113B and the fourth movable track 116B selectively moved leftward or rightward, the movement of the slider 12 on the sliding rail 11 can be a ∞-shaped (i.e., symbol of number 8) or water drop-shaped.

Figure 11B:
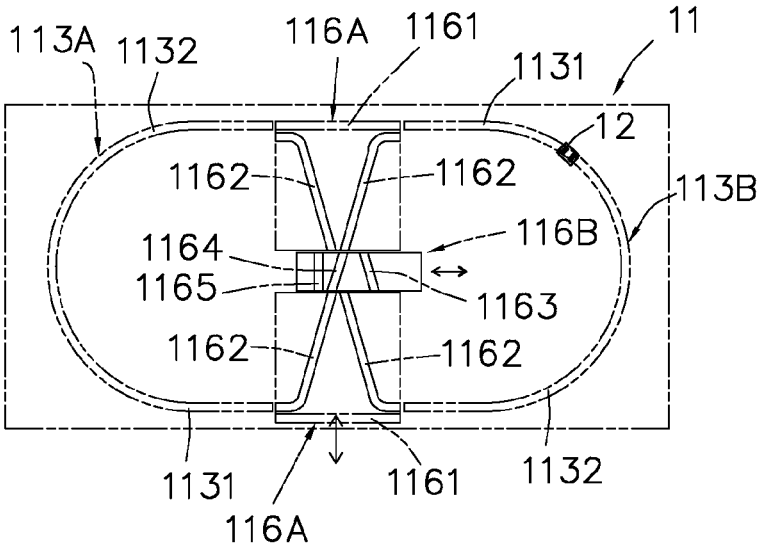
FIG. 11B is diagram of illustrating the sliding rail of FIG. 11A showing the 8-shaped movement of the hanged leisure equipment in accordance with another embodiment the present invention.

With reference to FIGS. 11A and 11B, FIG. 11A discloses the left-inclined sub-track 1163 is used to connect two inclined L-sub-tracks 1162 of the pair of third movable tracks 116A. When the slider 12 moves from the top-left side of FIG. 11A toward to the second terminal 1132 of the U-track 113A, enters into one upper inclined L-sub-tracks 1162, passes through the left-inclined sub-track 1163 and enters into one lower inclined L-sub-tracks 1162 the second terminal 1132 of the left U-track 113B.

With reference to FIG. 11B, FIG. 11B discloses the right-inclined sub-track 1164 is connected between the pair of the third movable track 116A. The inclined L-sub-tracks 1162 of the third movable track 116A is connected to the right-inclined sub-track 1164 of the fourth movable track 116B by adjusting the third movable track 116A and the fourth movable track 116B. After the slider 12 moves from the second terminal 1132 of the U-track 113B to the first terminal 1131 of the U-track 113B, the slider 12 is sequentially moved to one upper inclined L-sub-tracks 1162, passed the right-inclined sub-track 1164, entered into another lower inclined L-sub-track 1162 and the first terminal of the U-track 113A to form a ∞-shaped moving tracking.

Figure 11C:
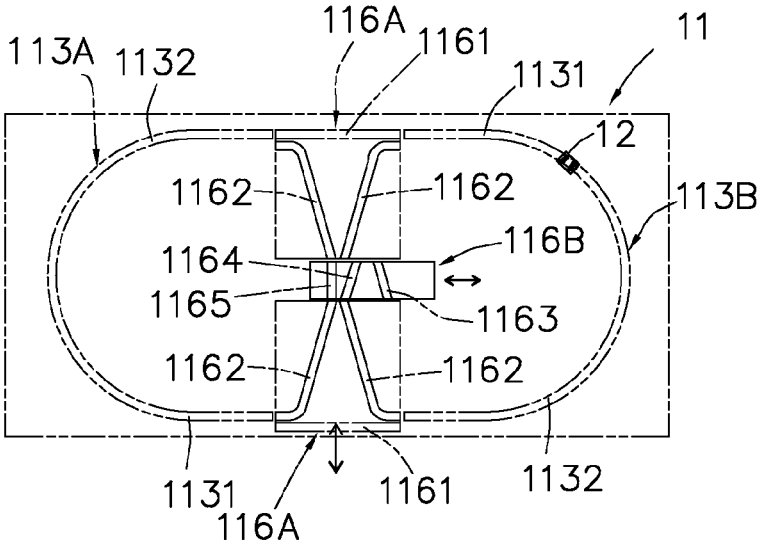
FIGS. 11C and 11D are diagrams of illustrating the sliding rail of FIG. 11A showing the different water drop movement of the hanged leisure equipment in accordance with another embodiment the present invention.
Figure 11D:
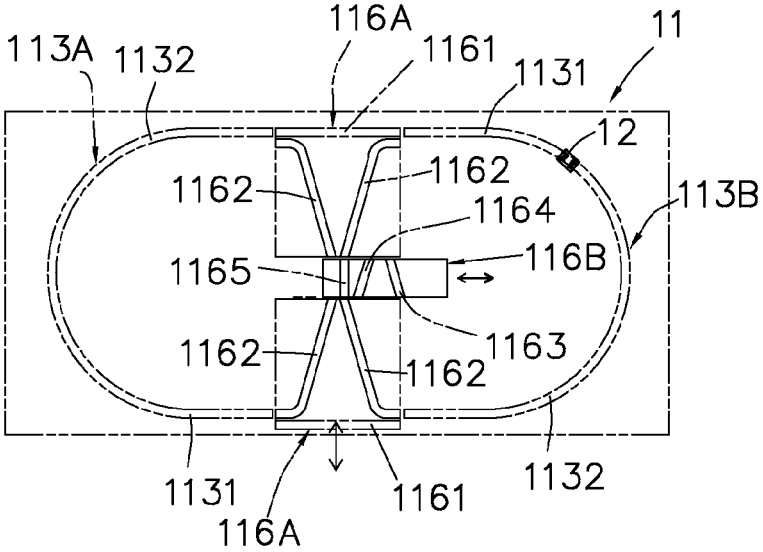

With reference to FIGS. 11C and 11D, FIGS. 11C and 11D are views of a water drop-shaped moving tracking formed by combining the straight sub-track 1165 with one end of the third movable track 116A. In FIG. 11C, the straight sub-track 1165 is used to connect two longitudinally symmetrical inclined L sub-tracks 1162, thus, the slider 12 moved from the second terminal 1132 passes the straight sub-track 1165 and two longitudinally symmetrical inclined L sub-tracks 1162 and enters the first terminal 1131 to form a water drop-shaped moving tracking. Also, in FIG. 11D, the slider 12 moved from the first terminal 1131 passes the straight sub-track 1165 and two longitudinally symmetrical inclined L sub-tracks 1162 and enters the second terminal 1132 to form a water drop-shaped moving tracking that is opposite corresponded to the water drop-shaped moving tracking in FIG. 11C.

Accordingly, the hanging module 2 is able to self-rotate, or move in an oval-, semi-oval-, S-, U-, or I-shaped, and the user choices the operation status based on the actual requirement to improve the relax efficiency.

While the invention has been described in connection with a number of embodiments and implementations, the invention is not so limited but covers various obvious modifications and equivalent arrangements, which fall within the purview of the appended claims. Although features of the invention are expressed in certain combinations among the claims, it is contemplated that these features can be arranged in any combination and order.

What is claimed is:

1. A leisure equipment with a hanging assembly comprising:

a processing module being mounted on a high elevated location, and comprising:

a sliding rail comprises at least one track;

a slider is disposed on the track; and at least one processing motor drives the sliding rail and the slider based on a predetermined regulation;

a hanging module being driven by the process motor to form a moving tracking and comprising:

a net body is weaved by multiple ropes that are collected to connect with a hanged end and the net body comprising:

an upper end is mounted on the hanged end;

a lower end has multiple twisted ropes to form a lower edge has two ends that are respectively connected to a fixed rope thereon;

a left end comprises multiple auxiliary units, each auxiliary unit is formed by twisting multiple ropes; and a right end comprises multiple auxiliary units, each auxiliary unit is formed by twisting multiple ropes; and an elongation unit, the elongation unit is configured for the fixed rope of the hanging module coupling to a second hook on an elongation rod of the elongation unit.

2. The leisure equipment with a hanging assembly as claimed in claim 1, wherein the leisure equipment further comprises a sitting module is disposed under the hanging module and comprises: a lower pad has a concave that is mounted on an upper surface of the lower pad and has an inner edge for multiple hooks disposed on; and an upper pad is disposed inside the concave.

3. The leisure equipment with a hanging assembly as claimed in claim 1, wherein the leisure equipment further comprises a collector, and the the upper end of the net body is configured for passing through the collector that is connected to the hanged end.

4. The leisure equipment with a hanging assembly as claimed in claim 3, wherein the collector comprises multiple first hooks being configure for fastening the fixed ropes.

5. The leisure equipment with a hanging assembly as claimed in claim 1, wherein the leisure equipment further comprises a auxiliary hanging module disposed between the processing module and the hanging module and comprises: a hanged rod has one end connected to the slider of the processing module; an upper coupled unit connected to the other end of the hanged rod; a lower coupled unit upwardly connected to the upper coupled unit; a first hanged rod extended between the upper coupled unit and the lower coupled unit; and a pair of second hanged rod extended between the upper coupled unit and the lower coupled, and forms a Y type with the first hanged rod.

6. The leisure equipment with a hanging assembly as claimed in claim 1, wherein the sliding rail comprises: a pair of first track paralleled to each other; and a second track that is vertically disposed between two paralleled first tracks.

7. The leisure equipment with a hanging assembly as claimed in claim 6, wherein the slider moved along the sliding rail to form an S-, an I-, a U-, a semi-oval, a number 8, or a water drop shaped moving tracking.

8. The leisure equipment with a hanging assembly as claimed in claim 1, wherein the sliding rail comprises: a pair of U-track, each U-track has an opening oppositely corresponds to each other; and a movable track comprises: a pair of sub-track paralleled disposed and connected to the U-tracks; and an S-track is disposed between the sub-tracks.

9. The leisure equipment with a hanging assembly as claimed in claim 8, wherein the slider moved along the sliding rail to form an S-, an I-, a U- or a semi-oval shaped moving tracking.

10. The leisure equipment with a hanging assembly as claimed in claim 1, wherein the sliding rail comprises: a pair of U-track, each U-track has an opening oppositely corresponds to each other; and a movable track is moved upwardly and downwardly and comprises: a pair of first movable track; and a vertically mounted second movable track being mounted between the pair of the first movable track and being configure for moving rightward and leftward.

11. The leisure equipment with a hanging assembly as claimed in claim 10, wherein the slider moved along the sliding rail to form an S-, an I-, a U-, a semi-oval, or a number 8 shaped moving tracking.

12. The leisure equipment with a hanging assembly as claimed in claim 10, wherein the pair of first movable track, each first movable track comprises: a straight track is horizontally mounted between the U-tracks and is configure to connect the U-tracks; and two oppositely disposed L-tracks disposed inside the straight track, and has two ends, one end is connected to the U-track, and the other end is connected to the second movable track.

13. The leisure equipment with a hanging assembly as claimed in claim 12, wherein the slider moved along the sliding rail to form an S-, an I-, a U-, a semi-oval, a number 8, or a water drop shaped moving tracking.

14. The leisure equipment with a hanging assembly as claimed in claim 1, wherein the slider moved along the sliding rail to form an S-, an I-, a U-, a semi-oval, a number 8, or a water drop shaped moving tracking.

15. The leisure equipment with a hanging assembly as claimed in claim 1, wherein the sliding rail comprises: a pair of U-track, each U-track has an opening oppositely corresponds to each other; and a multi-movable track moves upwardly and downwardly and comprises: a pair of third movable track, each third movable track comprises: a straight sub-track is horizontally disposed between the U-tracks to connect the U-tracks; and a pair of inclined L-sub-track that are symmetrical to each other, and disposed inside the straight sub-track, each inclined L-sub-track has one end to connect with one U-track; and a fourth movable track that is disposed between the pair of third movable track and is moved rightward and leftward and comprises a left-inclined sub-track, a right-inclined sub-track and a straight sub-track, and the left-inclined sub-track, the right-inclined sub-track and the straight sub-track connect to the other end of the inclined L-sub-track.

16. The leisure equipment with a hanging assembly as claimed in claim 15, wherein the slider moved along the sliding rail to form an S-, an I-, a U-, a semi-oval, a number 8, or a water drop shaped moving tracking.

17. The leisure equipment with a hanging assembly as claimed in claim 1, wherein the auxiliary unit is used for held, grabbed or worn by hands of a person.

18. The leisure equipment with a hanging assembly as claimed in claim 1, the hanging module further comprises a collector, the collector comprises two first hooks being respectively connected to the two ends of the collector, and the lower edge of the net body being turned upwardly which makes the hanging module to form a sitting groove.

* * * * *